US011100884B2

(12) United States Patent
Qiu

(10) Patent No.: US 11,100,884 B2
(45) Date of Patent: Aug. 24, 2021

(54) BOOSTER CIRCUIT OF DISPLAY PANEL, BOOST CONTROL METHOD AND DISPLAY DEVICE

(71) Applicant: HKC CORPORATION LIMITED, Shenzhen (CN)

(72) Inventor: Bin Qiu, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/040,981

(22) PCT Filed: Jan. 29, 2019

(86) PCT No.: PCT/CN2019/073628
§ 371 (c)(1),
(2) Date: Sep. 24, 2020

(87) PCT Pub. No.: WO2020/133633
PCT Pub. Date: Jul. 2, 2020

(65) Prior Publication Data

US 2021/0097954 A1 Apr. 1, 2021

(30) Foreign Application Priority Data

Dec. 27, 2018 (CN) ..... 201811607343.9

(51) Int. Cl.
*G09G 3/36* (2006.01)

(52) U.S. Cl.
CPC ..... *G09G 3/3696* (2013.01); *G09G 3/3677* (2013.01); *G09G 2310/0243* (2013.01);
(Continued)

(58) Field of Classification Search
CPC ..... G09G 3/3696; G09G 3/3677; G09G 2310/0291; G09G 2310/0286;
(Continued)

(56) References Cited

U.S. PATENT DOCUMENTS 10,135,340 B1 * 11/2018 Megaw ..... H02M 3/1582
2006/0164377 A1 7/2006 Struebel et al.
(Continued)

FOREIGN PATENT DOCUMENTS

CN 107395006 A 11/2007
CN 102945655 A 2/2013
(Continued)

OTHER PUBLICATIONS

Chang Liu, the ISA written comments,Sep. 2019, CN.
Chang Liu, the International Search Report, dated Sep. 2019, CN.

*Primary Examiner* — David Tung

(57) ABSTRACT

This application discloses a booster circuit of a display panel, a boost control method and a display device. The booster circuit of the display panel includes: a potential boosting circuit, used for boosting a potential of an input signal to generate a drive signal; a current detection circuit, used for detecting a real-time current value of the drive signal and outputting a corresponding detection signal; and a main control circuit in control connection with the potential boosting circuit, the potential boosting circuit outputting the drive signal to an output end of the booster circuit, and the main control circuit controlling the booster circuit to stop outputting the drive signal when the detection signal output by the current detection circuit satisfies a preset condition.

13 Claims, 3 Drawing Sheets

(52) U.S. Cl.
CPC ..... *G09G 2310/0286* (2013.01); *G09G 2310/0291* (2013.01); *G09G 2330/025* (2013.01); *G09G 2330/04* (2013.01); *G09G 2330/12* (2013.01)

(58) Field of Classification Search
CPC ..... G09G 2310/0243; G09G 2330/04; G09G 2330/025; G09G 2330/12
See application file for complete search history.

(56) References Cited

U.S. PATENT DOCUMENTS

| | | | | |
|---|---|---|---|---|
| 2009/0160367 | A1* | 6/2009 | Imanaka | H05B 45/37 315/307 |
| 2016/0291626 | A1* | 10/2016 | Tanaka | H03K 19/017509 |
| 2018/0096646 | A1* | 4/2018 | Zeng | G09G 3/3688 |
| 2019/0121483 | A1* | 4/2019 | Liu | G06F 3/0446 |

FOREIGN PATENT DOCUMENTS

| | | | |
|---|---|---|---|
| CN | 104200790 | A | 12/2014 |
| CN | 206212335 | U | 5/2017 |
| CN | 107393491 | A | 11/2017 |
| CN | 108631259 | A | 10/2018 |
| CN | 108767810 | A | 11/2018 |

* cited by examiner

BOOSTER CIRCUIT OF DISPLAY PANEL, BOOST CONTROL METHOD AND DISPLAY DEVICE

CROSS REFERENCE OF RELATED APPLICATIONS

This application claims the priority to the Chinese Patent Application No. CN201811607343.9, filed with National Intellectual Property Administration, PRC on Dec. 27, 2018 and entitled "Booster Circuit of Display Panel, Boost Control Method, and Display Device thereof", which is incorporated herein by reference in its entirety.

TECHNICAL FIELD

This application relates to the technical field of displays, and in particular, to a booster circuit of a display panel, a boost control method, and a display device.

BACKGROUND

Statement herein merely provides background information related to this application and does not necessarily constitute the existing technology.

With development and advancement of science and technologies, due to hot spots such as thinness, power saving, and low radiation, liquid crystal displays become mainstream products of displays and are widely applied. Nowadays, with the increasing popular demands for TV narrow borders, a novel Gate Driver Less (GDL) is becoming more and more popular. However, a liquid crystal panel requires a Gate Integrated Circuit (Gate IC) to be attached thereto, and the size of the Gate IC limits further narrowing of a border. However, in recent years, with the advent of a novel Gate Driver Less (GDL) technology, a GDL circuit splits an original Gate IC into two parts: a level shifter IC and a shift register. The level shifter IC is made on a driver board, the shift register is made on a panel, and the level shifter IC transmits a clock signal (CLK) to the shift register to complete the drive, so that the Gate IC is not required. Therefore, the border length can be further compressed.

However, due to the producing process, when a display panel is short-circuited or undergoes other abnormalities during use, current in the display panel may be excessive, and a chip or a screen of the display panel may be burned out.

SUMMARY

This application provides a booster circuit of a display panel, a boost control method and a display device, which improve a situation in which an instantaneous current is excessive and a screen is burned out.

This application also discloses a booster circuit of a display panel, including: a potential boosting circuit, used for boosting a potential of an input signal to generate a drive signal; a current detection circuit, used for detecting a real-time current value of the drive signal output by the potential boosting circuit and outputting a corresponding detection signal; and a main control circuit in control connection with the potential boosting circuit, the main control circuit controlling the booster circuit to stop outputting the drive signal when it is detected that the detection signal output by the current detection circuit satisfies a preset condition.

Optionally, a latching circuit is further arranged between the current detection circuit and the main control circuit; and the latching circuit receives the detection signal output by the current detection circuit, after it is detected that the detection signal satisfies the preset condition, the latching circuit continuously outputs a latching signal to the main control circuit, and the main control circuit controls the booster circuit to stop outputting the drive signal.

Optionally, when detecting that a current value of the drive signal is smaller than or equal to a preset threshold, the current detection circuit outputs a first reference voltage to the latching circuit; and when detecting that the current value is greater than the preset threshold, the current detection circuit outputs a second reference voltage to the latching circuit.

Optionally, the latching circuit includes a first switch and a second switch; a control end of the first switch is connected to an input end of the latching circuit, the first reference voltage is input to an input end of the first switch, and an output end of the first switch is connected to a control end of the second switch and an output end of the latching circuit; and the second reference voltage is input to an input end of the second switch, an output end of the second switch is connected to the control end of the first switch, and a second resistor is connected between the control end of the second switch and the input end of the second switch.

Optionally, when the input end of the latching circuit inputs the first reference voltage output by the current detection circuit, the first switch is turned off, and the second switch is turned off; and the latching circuit outputs the second reference voltage.

Optionally, when the input end of the latching circuit inputs the second reference voltage output by the current detection circuit, the first switch is turned on, the first switch outputs the first reference voltage to the control end of the second switch and the main control circuit to control the main control circuit to be closed, simultaneously the second switch is turned on and continuously outputs the second reference voltage to the control end of the first switch.

Optionally, a first resistor is connected between the control end of the first switch and the input end of the first switch.

Optionally, the current detection circuit includes: a sensing resistor, connected in series between an output end of the potential boosting circuit and an output end of the booster circuit; a first voltage obtaining circuit, collecting a first voltage of the output end of the potential boosting circuit; a second voltage obtaining circuit, collecting a second voltage of the output end of the booster circuit; and a comparison circuit, comparing a difference between the first voltage and the second voltage with a preset threshold, outputting a first detection signal to the main control circuit when the difference is greater than the preset threshold, and outputting a second detection signal when the difference is smaller than the preset threshold.

Optionally, the comparison circuit is an operational amplifier, and an operation method of the operational amplifier is a subtraction operation.

Optionally, the first voltage obtaining circuit includes a fourth resistor and a fifth resistor; the second voltage obtaining circuit includes a sixth resistor; the fourth resistor and the fifth resistor are connected in series between an output end of the booster circuit and a low level, such that the first voltage obtaining circuit collects the first voltage of the output end of the potential boosting circuit; a first input end of the comparison circuit is connected between the fourth resistor and the fifth resistor, and a voltage obtained by the first voltage obtaining circuit is output to the first input end of the comparison circuit; and the sixth resistor is connected between a second input end of the comparison circuit and the output end of the booster circuit, such that the second voltage obtaining circuit obtains a voltage of the output end of the booster circuit.

Optionally, the current detection circuit further includes a seventh resistor, the seventh resistor being connected between the second input end and an output end of the comparison circuit.

Optionally, the fourth resistor, the fifth resistor, the sixth resistor and the seventh resistor have the same resistance value.

Optionally, the fourth resistor, the fifth resistor, the sixth resistor and the seventh resistor have different resistance values.

Optionally, a third resistor is arranged between the input end of the latching circuit and an output end of the current detection circuit.

This application also provides a boost control method for a booster circuit of a display panel as described above, including the following steps:

receiving, by a potential boosting circuit, an input signal, and boosting a potential of the input signal to generate a drive signal;

detecting a real-time current value of the drive signal output by the potential boosting circuit; and determining whether a real-time current value of a drive signal output by an output end of a booster circuit exceeds a preset threshold, normally outputting, by the potential boosting circuit, the drive signal when it is detected that the real-time current value does not exceed the preset threshold, and controlling the potential boosting circuit to stop outputting the drive signal when it is detected that the real-time current value exceeds the preset threshold.

Optionally, in the step of determining whether a real-time current value of a drive signal output by an output end of a booster circuit exceeds a preset threshold. normally outputting, by the potential boosting circuit, the drive signal when it is detected that the real-time current value does not exceed the preset threshold, and controlling the potential boosting circuit to stop outputting a drive signal when it is detected that the real-time current value exceeds the preset threshold, when it is detected that the real-time current value exceeds the preset threshold, a latching circuit continuously outputs a second reference voltage to a main control circuit, and the main control circuit controls the potential boosting circuit to stop outputting the drive signal.

This application also provides a display device, including: a display panel; and a drive circuit, used for driving the display panel, the drive circuit including a booster circuit, the booster circuit including: a potential boosting circuit, used for boosting a potential of an input signal to generate a drive signal and outputting the drive signal to an output end of the booster circuit; a current detection circuit, used for detecting a real-time current value of the drive signal output by the potential boosting circuit and outputting a corresponding detection signal; and a main control circuit in control connection with the potential boosting circuit, the main control circuit controlling the booster circuit to stop outputting the drive signal when it is detected that the detection signal output by the current detection circuit satisfies a preset condition.

Optionally, the drive circuit includes a gate drive circuit, the gate drive circuit including: a shift circuit and the booster circuit, the shift circuit being formed on the display panel to provide a scanning signal for a scanning line of the display panel.

With respect to a situation in which when a display panel is short-circuited or undergoes other abnormalities during use, current in the display panel may be excessive instantaneously and a chip or a screen of the display panel may be burned out, in this solution, a current detection circuit is added to a booster circuit for voltage boosting and used for detecting a real-time current value of an output end of the booster circuit, and when the real-time current exceeds a preset threshold, a detection signal satisfying a preset condition is output to trigger a main control circuit to control the booster circuit to stop outputting a drive signal. By such a design, even if a large current occurs instantaneously, boost can be stopped for protection, and the protection effect is very good.

BRIEF DESCRIPTION OF DRAWINGS

The included accompanying drawings are used to provide further understanding of the embodiments of this application, constitute a part of the specification, and are used to illustrate implementations of this application and explain the principle of this application together with literal descriptions. Apparently, the accompanying drawings in the following descriptions are merely some embodiments of this application, and a person of ordinary skill in the art can also obtain other accompanying drawings according to these accompanying drawings without involving any creative effort. In the accompanying drawings.

DETAILED DESCRIPTION OF EMBODIMENTS

Figure 1:
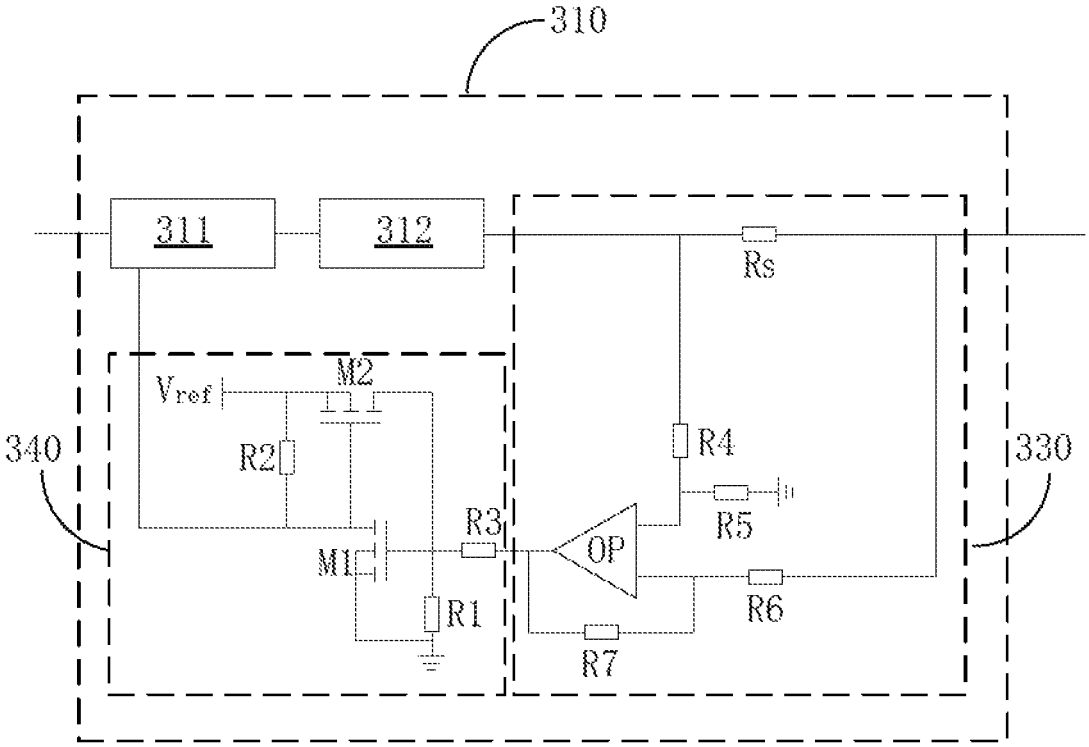
FIG. 1 is a schematic diagram of a booster circuit of a display panel according to an embodiment of this application.

Specific structures and functional details disclosed herein are merely representative, and are intended to describe the objectives of the exemplary embodiments of this application. However, tis application may be specifically implemented in many alternative forms, and should not be construed as being limited to the embodiments set forth herein.

In the description of this application, it should be understood that orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly includes one or more of said features. In the description of this application, unless otherwise stated, "a plurality of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection or the connection may be a direct connection, an indirect connection through an intermediary, or internal communication between two components. Persons of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, and/or operations, but do not preclude the presence or addition of one or more other features, integers, steps, operations, and/or combinations thereof.

This application is further described below with reference to the accompanying drawings and alternative embodiments.

As shown in FIG. 1, an embodiment of this application discloses a booster circuit 310 of a display panel, including: a potential boosting circuit 312, used for boosting a potential of an input signal to generate a drive signal; a current detection circuit 330, used for detecting a real-time current value of the drive signal output by the potential boosting circuit 312, and outputting a corresponding detection signal; and a main control circuit 311 in control connection with the potential boosting circuit 312, the main control circuit 311 controlling the booster circuit 310 to stop outputting the drive signal when it is detected that the detection signal output by the current detection circuit satisfies a preset condition.

If a display panel is short-circuited or undergoes other abnormalities during use, current in the display panel may be increased instantaneously, and a chip or a screen of the display panel may be burned out once the current exceeds a current protection value of the display panel. In this solution, a current detection circuit is additionally arranged into the booster circuit 310 for voltage boosting and used for detecting a real-time current value of an output end, and when the real-time current exceeds a preset threshold (the preset threshold is a specific current value, e.g., set as 1 amp, and when the current exceeds 1 amp, a condition is satisfied), a detection signal satisfying a preset condition (satisfying a preset condition is: determining whether the current value is a detectable current value, and satisfying the condition when a current value is reached) is output to trigger the main control circuit 311 to control the booster circuit 310 to stop outputting the drive signal. By such a design, even if a large current occurs instantaneously, boost can be stopped for protection, and the protection effect is very good.

A latching circuit 340 is further arranged between the current detection circuit 330 and the main control circuit 311. The latching circuit 340 receives the detection signal output by the current detection circuit 330. After it is detected that the detection signal satisfies the preset condition, the latching circuit 340 continuously outputs a latching signal to the main control circuit 311. The main control circuit 311 controls the booster circuit 310 to stop outputting the drive signal. A preset logic is that the current detection circuit 330 detects whether current output by the potential boosting circuit 312 exceeds a certain set threshold.

When the latching circuit 340 detects that the detection signal satisfies the preset condition, the current detection circuit 330 detects that current of an output end of the booster circuit 310 is excessive instantaneously, the latching circuit 340 outputs a latching signal. Then, when the current of the output end of the booster circuit 310 returns to normal, the latching circuit 340 continuously outputs a latching signal, which will not continuously change due to the output fluctuation of the current detection circuit 330, the main control circuit 311 is controlled to continuously stop outputting the drive signal, and cannot automatically restore, so as to remind of timely check, thereby avoiding more serious consequences such as screen burning or even fire.

When detecting that a current value of the drive signal is smaller than or equal to a preset threshold, the current detection circuit 330 outputs a first reference voltage to the latching circuit 340. When detecting that the current of the output end is greater than the preset threshold, the current detection circuit 330 outputs a second reference voltage to the latching circuit 340. The latching circuit 340 includes a first switch (M1) and a second switch (M2). A control end of M1 is connected to an input end of the latching circuit 340. The first reference voltage is input to an input end of M1. An output end of M1 is connected to a control end of M2 and an output end of the entire latching circuit 340. The second reference voltage is input to an input end of M2. An output end of M2 is connected to the control end of M1. R2 is connected between the control end of M2 and the input end of M2. When the input end of the latching circuit 340 inputs the first reference voltage output by the current detection circuit, M1 is turned off, and M2 is turned off. The latching circuit 340 outputs the second reference voltage. When the input end of the latching circuit 340 inputs the second reference voltage output by the current detection circuit, M1 is turned on, M1 outputs the first reference voltage to the control end of M2 and the main control circuit 311 to control the main control circuit 311 to be closed, and M2 is turned on and outputs the second reference voltage to the control end of M1. Thus, regardless of input of a high-level or low-level signal to the current detection circuit 330 after the input end of the latching circuit 340 outputs one high-level signal to the current detection circuit 330. M1 is continuously turned on due to the second reference voltage continuously output by M2, and M1 continuously outputs the first reference voltage to the output end of the latching circuit 340. M1 is an NMOS transistor. The NMOS transistor is turned on at a relatively high level and turned off at a relatively low level. M2 is a PMOS transistor. The PMOS transistor is turned on at a relatively low level and turned off at a relatively high level. The first reference voltage is a low level, which may be grounded or may be a relatively low level. The second reference voltage is a high level. The high level may also be a relatively high level as well.

The current detection circuit 330 may correspondingly output a detection signal according to the current magnitude of the output drive signal. When detecting that the current of the output end is smaller than the preset threshold, the current detection circuit 330 outputs a first reference signal. When detecting that the current of the output end is greater than the preset threshold, the current detection circuit 330 outputs a second reference signal. When the control end of M1 receives the first reference signal, M1 is turned off, the control end of M2 receives the second reference signal, and M2 is turned off. When the control end of M1 receives the second reference signal, M1 is turned on, the input end of M1 inputs the first reference signal, the output end of M1 outputs the first reference signal to the control end of M2, M2 is turned on and outputs the second reference signal to the control end of M1, M1 is turned on, and M1 is turned on and outputs the first reference signal to M2. In this cycle, M1 continuously outputs the first reference signal to the output end of the latching circuit 340, and the latching circuit 340 continuously outputs the first reference signal.

A first resistor (R1) is connected between the control end of M1 and the input end of M1. R1 protects M1 when the control end of M1 receives a high level. R1 is located between the input end and the control end of M1. When the control end of M1 receives a high level, M1 can be prevented from being damaged due to excessive current, thus ensuring the normal operation of M1.

The current detection circuit 330 further includes: a sensing resistor (Rs), connected in series between an output end of the potential boosting circuit and an output end of the booster circuit 310; a first voltage obtaining circuit, collecting a first voltage of the output end of the potential boosting circuit; a second voltage obtaining circuit, collecting a second voltage of the output end of the booster circuit; and a comparison circuit (Operational Amplifier (OP)), comparing a difference between the first voltage and the second voltage with a preset threshold, outputting a first detection signal to the main control circuit 311 when the difference is greater than the preset threshold, and outputting a second detection signal when the difference is smaller than the preset threshold. The first voltage obtaining circuit and the second voltage obtaining circuit are circuits connected to both ends of the sensing resistor, and voltages of both ends of the sensing resistor are obtained and transmitted to the comparison circuit. The comparison circuit is an operational amplifier, and a subtraction circuit.

The current detection method of the current detection circuit 330 is: providing Rs between the output end of the potential boosting circuit and the output end of the booster circuit 310, providing a first voltage obtaining circuit and a second voltage obtaining circuit at both ends of Rs respectively, collecting voltages of both ends of Rs through two voltage obtaining modules, obtaining a voltage difference of both ends through the comparison circuit, comparing the voltage difference with a preset threshold, outputting a first detection signal to the main control circuit 311 when the voltage difference is greater than the preset threshold, and outputting a second detection signal when the voltage difference is smaller than the preset threshold.

The first voltage obtaining circuit includes a fourth resistor (R4) and a fifth resistor (R5). The second voltage obtaining circuit includes a sixth resistor (R6). R4 and R5 are connected in series between the output end of the booster circuit and a low level, such that the first voltage obtaining circuit collects the first voltage of the output end of the potential boosting circuit 312. A first input end of the OP is connected between R4 and R5, and a voltage obtained by the first voltage obtaining circuit is output to the first input end of the OP. R6 is connected between a second input end of the OP and the output end of the booster circuit 310, such that the second voltage obtaining circuit obtains a voltage of the output end of the booster circuit. The current detection circuit further includes a seventh resistor (R7). R7 is connected between the second input end and an output end of the OP.

By adjusting the resistance values of the respective resistors, the preset threshold of the current detection circuit 330 may be adjusted according to actual needs, and the resistance values of R4, R5, R6, and R7 may be set as equal resistance values or different resistance values. In the current detection circuit 330, an algorithm of a current detection signal output by the OP is: the resistance values of R4, R5, R6, and R7 are set as equal resistance values; assuming that a first voltage is V1, a second voltage is V2, a first input end voltage is V+, a second input end voltage is V−, an OP output voltage is Vout, the OP is a subtraction circuit, a positive polarity input end V+ of the OP is V divided by R4 and R, and the resistance values of the two resistors are the same, so V+=(V1)/2; and a negative polarity second input end V− of the OP is a difference between an actual output V2 and an OP output Vout, V−=V2−(V2−Vout)/2=(V2+Vout)/2, and V+=V− according to the characteristics of the OP, so (V1)/2=(V2+Vout)/2, that is, V1=V2+Vout, and finally, Vout=V1−V2. Vout is a voltage difference between V1 and V2. Therefore, the detection signal output by the current detection circuit 330 is the voltage difference between both ends of Rs. Since the voltage is proportional to the current, it may be determined whether the current of the drive signal exceeds a preset threshold by means of the voltage difference of Rs.

A third resistor (R3) is arranged between the input end of the latching circuit 340 and the output end of the current detection circuit 330. R3 may protect the OP. When M2 outputs a high level, if a low level is output by the OP M2 will have a reverse current. If there is no R3, the output of current to the OP makes the OP easily damaged, so R3 may be provided to protect the OP to prevent a high-level voltage output by M2 from being output to the OP, so that the OP is easily burned and damaged when receiving the high-level voltage.

Figure 2:
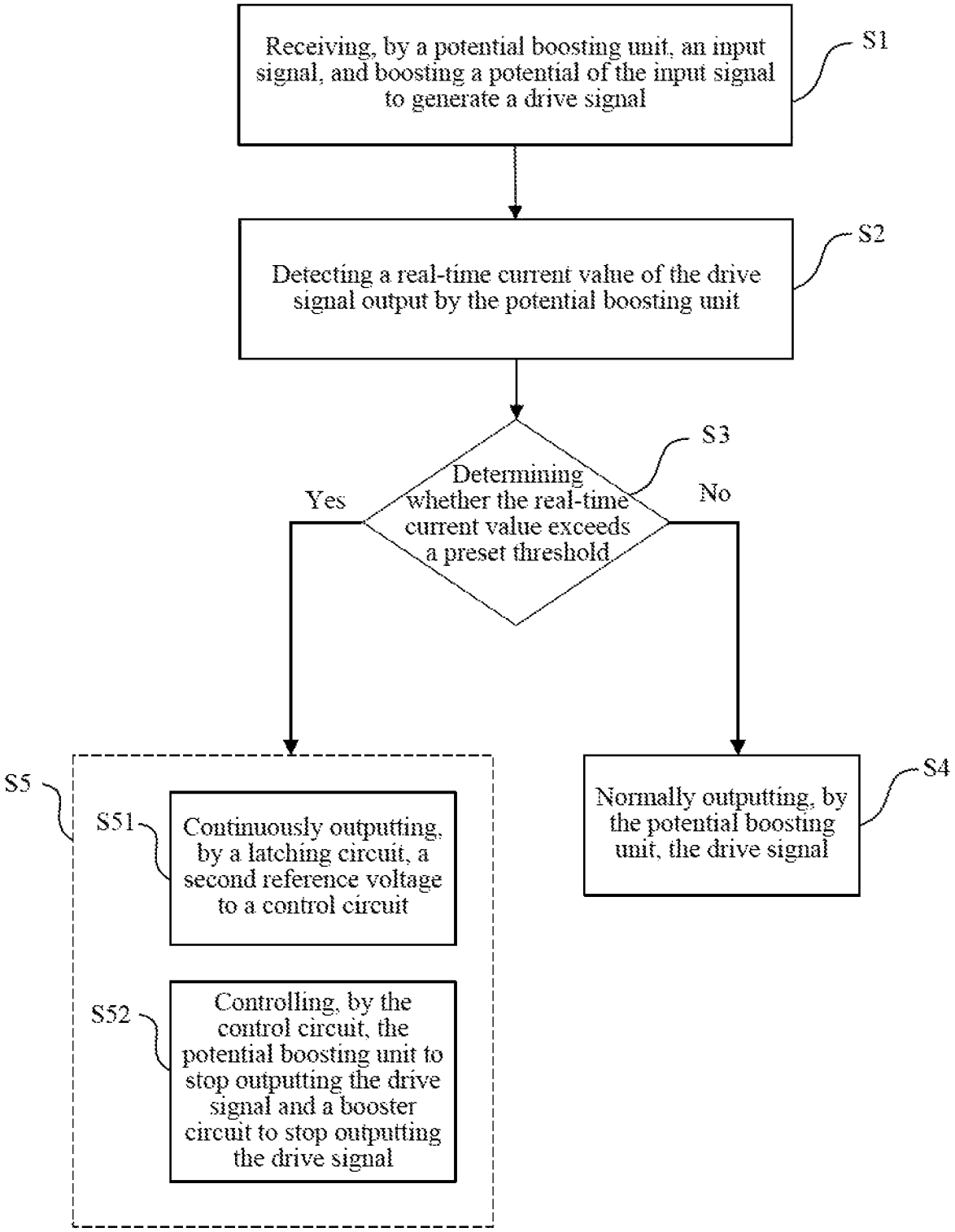
FIG. 2 is a schematic flowchart of an over-current protection method for a display panel according to an embodiment of this application.

FIG. 2 is a flowchart of a boost control method for a display panel. Referring to FIG. 2 and FIG. 1, as another embodiment of this application, disclosed is a boost control method for a booster circuit 310 of a display panel 200 as described above, including the following steps:

S1: receiving, by a potential boosting circuit, an input signal, and boosting a potential of the input signal to generate a drive signal;

S2: detecting a real-time current value of the drive signal output by the potential boosting circuit; and S3: determining whether a real-time current value of a drive signal output by an output end of a booster circuit exceeds a preset threshold:

S4: normally outputting, by the potential boosting circuit, the drive signal when it is detected that the real-time current value does not exceed the preset threshold; and S5: controlling the potential boosting circuit to stop outputting the drive signal when it is detected that the real-time current value exceeds the preset threshold.

Step S5 includes:

S51: continuously outputting, by a latching circuit, a low level as a first reference voltage to a main control circuit when it is detected that the real-time current value exceeds the preset threshold.

S52: controlling, by the main control circuit, the potential boosting circuit to stop outputting the drive signal and the booster circuit to stop outputting the drive signal.

This solution is an over-current protection method for a display panel 200. In the booster circuit 310, an input signal is received, and a potential of the input signal is boosted. A drive signal is output to an output end of the booster circuit 310. A current detection circuit 330 is arranged at the output end of the booster circuit 310. The current detection circuit 330 detects a real-time current value of the drive signal, controls whether the booster circuit 310 outputs the drive signal according to the real-time current value and the magnitude of a preset threshold, and controls, when it is detected that the real-time current value of the drive signal output by the output end of the booster circuit 310 exceeds the preset threshold, the booster circuit 310 to stop outputting the drive signal and to continuously stop outputting the drive signal.

Figure 3:
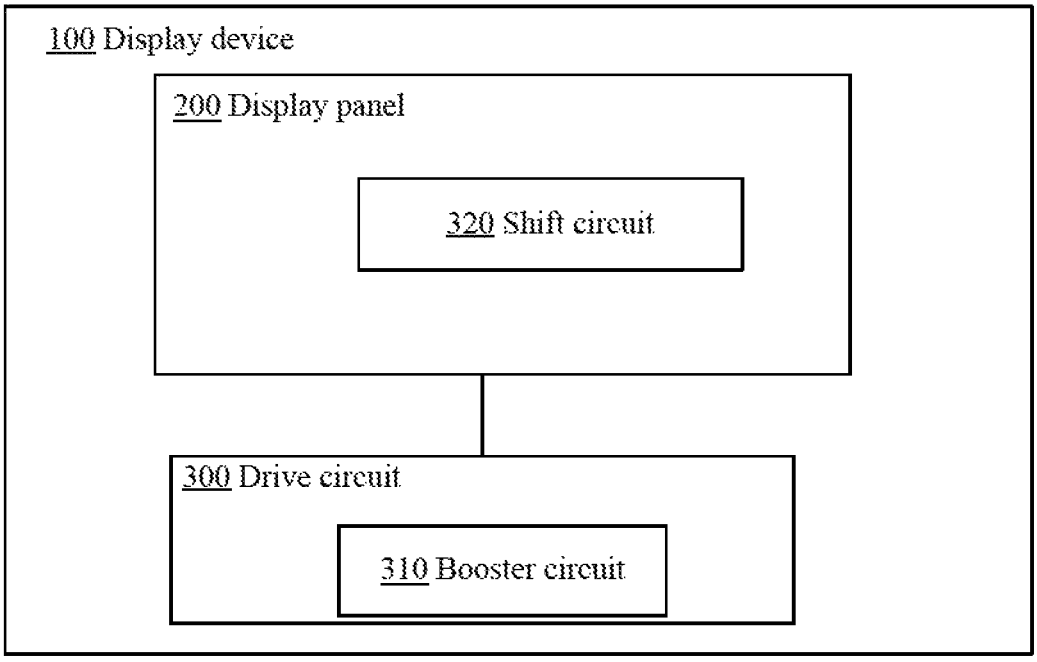
FIG. 3 is a schematic diagram of a display device according to an embodiment of this application.

Referring to FIG. 3, disclosed is a display device 100, including: a display panel 200 and a drive circuit 300 for driving the display panel 200. The drive circuit 300 includes a booster circuit. The booster circuit includes: a potential boosting circuit, used for boosting a potential of an input signal to generate a drive signal and outputting the drive signal to an output end of the booster circuit; a current detection circuit, used for detecting a real-time current value of the drive signal output by the potential boosting circuit and outputting a corresponding detection signal; and a main control circuit in control connection with the potential boosting circuit, the main control circuit controlling the booster circuit to stop outputting the drive signal when it is detected that the detection signal output by the current detection circuit satisfies a preset condition.

The drive circuit 300 includes a gate drive circuit. The gate drive circuit includes a shift circuit 320 and the booster circuit 310, where the booster circuit 310 may be arranged on a circuit board and used for outputting a boosted drive signal to the shift circuit; and the shift circuit 320 may be formed on the display panel, or may be arranged on the circuit board together with the booster circuit, so as to provide a scanning signal for a scanning line of the display panel 200. The shift circuit 320 of the gate drive circuit is arranged on the display panel 200 to reduce the volume of the circuit board. This design can further compress the border length of the display panel 200, which is advantageous for reducing the black border width of the display panel 200.

It should be noted that the limitation of each step involved in this solution is not determined to limit the sequence of steps without affecting the implementation of a specific solution. The previous steps may be performed first, or may be performed later, or may be performed even simultaneously. As long as this solution can be implemented, it should be considered as falling within the protection scope of this application.

The technical solution of this application may be widely applied to a Twisted Nematic (TN) panel, an In-Plane Switching (IPS) panel, or a Multi-domain Vertical Alignment (VA) panel, and may certainly be applied to any other suitable type of panel.

The foregoing contents are detailed descriptions of this application in conjunction with specific optional embodiments, and it should not be considered that the specific implementation of this application is limited to these descriptions. Persons of ordinary skill in the art can further make simple deductions or replacements without departing from the concept of this application, and such deductions or replacements should all be considered as falling within the protection scope of this application.

What is claimed is:

1. A booster circuit of a display panel, comprising:

a potential boosting circuit, used for boosting a potential of an input signal to generate a drive signal;

a current detection circuit, used for detecting a real-time current value of the drive signal output by the potential boosting circuit and outputting a corresponding detection signal; and a main control circuit in control connection with the potential boosting circuit, the main control circuit controlling the booster circuit to stop outputting the drive signal when it is detected that the detection signal output by the current detection circuit satisfies a preset condition;

wherein a latching circuit is further arranged between the current detection circuit and the main control circuit; and the latching circuit receives the detection signal output by the current detection circuit, after it is detected that the detection signal satisfies the preset condition, the latching circuit continuously outputs a latching signal to the main control circuit, and the main control circuit controls the booster circuit to stop outputting the drive signal;

when detecting that a current value of the drive signal is smaller than or equal to a preset threshold, the current detection circuit outputs a first reference voltage to the latching circuit; and when detecting that the current value is greater than the preset threshold, the current detection circuit outputs a second reference voltage to the latching circuit;

wherein the latching circuit comprises a first switch and a second switch;

a control end of the first switch is connected to an input end of the latching circuit, the first reference voltage is input to an input end of the first switch, and an output end of the first switch is connected to a control end of the second switch and an output end of the latching circuit; and the second reference voltage is input to an input end of the second switch, an output end of the second switch is connected to the control end of the first switch, and a second resistor is connected between the control end of the second switch and the input end of the second switch.

2. The booster circuit of a display panel according to claim 1, wherein when the input end of the latching circuit inputs the first reference voltage output by the current detection circuit, the first switch is turned off, and the second switch is turned off; and the latching circuit outputs the second reference voltage.

3. The booster circuit of a display panel according to claim 1, wherein when the input end of the latching circuit inputs the second reference voltage output by the current detection circuit, the first switch is turned on, the first switch outputs the first reference voltage to the control end of the second switch and the main control circuit to control the main control circuit to be closed, simultaneously the second switch is turned on and continuously outputs the second reference voltage to the control end of the first switch.

4. The booster circuit of a display panel according to claim 1, wherein a first resistor is connected between the control end of the first switch and the input end of the first switch.

5. The booster circuit of a display panel according to claim 1, wherein the current detection circuit comprises:

a sensing resistor, connected in series between an output end of the potential boosting circuit and an output end of the booster circuit;

a first voltage obtaining circuit, collecting a first voltage of the output end of the potential boosting, circuit;

a second voltage obtaining circuit, collecting a second voltage of the output end of the booster circuit; and a comparison circuit, comparing a difference between the first voltage and the second voltage with a preset threshold, outputting a first detection signal to the main control circuit when the difference is greater than the preset threshold, and outputting a second detection signal when the difference is smaller than the preset threshold.

6. The booster circuit of a display panel according to claim 5, wherein the comparison circuit is an operational amplifier, and an operation method of the operational amplifier is a subtraction operation.

7. The booster circuit of a display panel according to claim 5, wherein the first voltage obtaining circuit comprises a fourth resistor and a fifth resistor;

the second voltage obtaining circuit comprises a sixth resistor;

the fourth resistor and the fifth resistor are connected in series between an output end of the booster circuit and a low level, such that the first voltage obtaining circuit collects the first voltage of the output end of the potential boosting circuit;

a first input end of the comparison circuit is connected between the fourth resistor and the fifth resistor, and a voltage obtained by the first voltage obtaining circuit is output to the first input end of the comparison circuit; and the sixth resistor is connected between a second input end of the comparison circuit and the output end of the booster circuit, such that the second voltage obtaining circuit obtains a voltage of the output end of the booster circuit.

8. The booster circuit of a display panel according to claim 7, wherein the current detection circuit further comprises a seventh resistor, the seventh resistor being connected between the second input end and an output end of the comparison circuit.

9. The booster circuit of a display panel according to claim 8, wherein the fourth resistor, the fifth resistor, the sixth resistor and the seventh resistor have the same resistance value.

10. The booster circuit of a display panel according to claim 8, wherein the fourth resistor, the fifth resistor, the sixth resistor and the seventh resistor have different resistance values.

11. The booster circuit of a display panel according to claim 1, wherein a third resistor is arranged between the input end of the latching circuit and an output end of the current detection circuit.

12. A display device, comprising:

a display panel; and a drive circuit, used for driving the display panel, the drive circuit comprising a booster circuit, the booster circuit comprising:

a potential boosting circuit, used for boosting a potential of an input signal to generate a drive signal and outputting the drive signal to an output end of the booster circuit;

a current detection circuit, used for detecting a real-time current value of the drive signal output by the potential boosting circuit and outputting a corresponding detection signal; and a main control circuit in control connection with the potential boosting circuit, the main control circuit controlling the booster circuit to stop outputting the drive signal when it is detected the detection signal output by the current detection circuit satisfies a preset condition;

wherein the current detection circuit comprises:

a sensing resistor, connected in series between an output end of the potential boosting circuit and an output end of the booster circuit;

a first voltage obtaining circuit, collecting a first voltage of the output end of the potential boosting circuit;

a second voltage obtaining circuit, collecting a second voltage of the output end of the booster circuit; and a comparison circuit, comparing a difference between the first voltage and the second voltage with a preset threshold outputting a first detection signal to the main control circuit when the difference is greater than the preset threshold, and outputting a second detection signal when the difference is smaller than the preset threshold;

wherein the first voltage obtaining circuit comprises a fourth resistor and a fifth resistor;

the second voltage obtaining circuit comprises a sixth resistor;

the fourth resistor and the fifth resistor are connected in series between an output end of the booster circuit and a low level, such that the first voltage obtaining circuit collects the first voltage of the output end of the potential boosting circuit;

a first input end of the comparison circuit is connected between the fourth resistor and the fifth resistor, and a voltage obtained by the first voltage obtaining circuit is output to the first input end of the comparison circuit; and the sixth resistor is connected between a second input end of the comparison circuit and the output end of the booster circuit, such that the second voltage obtaining circuit obtains a voltage of the output end of the booster circuit.

13. The display device according to claim 12, wherein the drive circuit comprises a gate drive circuit, the gate drive circuit comprising:

a shift circuit and the booster circuit;

the shift circuit being formed on the display panel to provide a scanning signal for a scanning line of the display panel.

* * * * *